US009689256B2

(12) United States Patent
Tevis et al.

(10) Patent No.: US 9,689,256 B2
(45) Date of Patent: Jun. 27, 2017

(54) CORE ORIENTATION SYSTEMS AND METHODS

(71) Applicant: SCHLUMBERGER TECHNOLOGY CORPORATION, Sugar Land, TX (US)

(72) Inventors: George Christopher Tevis, Missouri City, TX (US); Mark Milkovisch, Cypress, TX (US); Kai Hsu, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 665 days.

(21) Appl. No.: 13/649,918

(22) Filed: Oct. 11, 2012

(65) Prior Publication Data

US 2014/0102794 A1 Apr. 17, 2014

(51) Int. Cl.

| | |
|---|---|
| ***E21B 47/024*** | (2006.01) |
| ***E21B 49/06*** | (2006.01) |
| ***E21B 25/16*** | (2006.01) |
| *E21B 47/026* | (2006.01) |

(52) U.S. Cl.

CPC ..... *E21B 49/06* (2013.01); *E21B 25/16* (2013.01); *E21B 47/024* (2013.01); *E21B 47/026* (2013.01)

(58) Field of Classification Search

CPC ..... E21B 49/06; E21B 25/16; E21B 47/024; E21B 47/026

See application file for complete search history.

(56) References Cited

U.S. PATENT DOCUMENTS

| | | | |
|---|---|---|---|
| 3,115,196 | A | 12/1963 | Roxstrom |
| 3,209,823 | A | 10/1965 | Winkel |
| 3,291,226 | A | 12/1966 | Winkel |
| 3,393,359 | A | 7/1968 | Winkel |
| 3,964,555 | A | 6/1976 | Franklin |
| 4,311,202 | A | 1/1982 | Kunz |
| 4,317,993 | A | 3/1982 | Hertzog, Jr. et al. |
| 4,468,623 | A | 8/1984 | Gianzero et al. |
| 4,704,581 | A | 11/1987 | Clark |
| 4,714,119 | A | 12/1987 | Hebert et al. |
| 5,021,653 | A | 6/1991 | Roscoe et al. |

(Continued)

FOREIGN PATENT DOCUMENTS

| | | | |
|---|---|---|---|
| GB | 2251307 | A | 7/1992 |
| WO | 03/040743 | A1 | 5/2003 |
| WO | 2007104103 | A1 | 9/2007 |

OTHER PUBLICATIONS

U.S. Appl. No. 13/631,154, filed Sep. 28, 2012.

*Primary Examiner* — Robert E Fuller
*Assistant Examiner* — David Carroll
(74) *Attorney, Agent, or Firm* — Trevor G. Grove

(57) ABSTRACT

Methods and systems for evaluating the subterranean formation of a wellbore are provided. In one embodiment, a geographical orientation of a downhole tool relative to Earth may be determined. The downhole tool may include a coring tool positioned to extract a core sample from a formation of the Earth. The orientation of the core sample with respect to the downhole tool also may be determined. Further, based on the geographical orientation of the downhole tool and the orientation of the coring sample, a geographical orientation of the core sample with respect to the Earth may be determined.

15 Claims, 8 Drawing Sheets

(56) References Cited

U.S. PATENT DOCUMENTS

| | | | | |
|---|---|---|---|---|
| 5,277,062 | A | 1/1994 | Blauch et al. | |
| 5,360,066 | A * | 11/1994 | Venditto et al. | 166/250.1 |
| 5,482,122 | A | 1/1996 | Abass et al. | |
| 5,663,559 | A | 9/1997 | Auzerais et al. | |
| 5,667,025 | A | 9/1997 | Haessly et al. | |
| 6,191,588 | B1 | 2/2001 | Chen | |
| 6,371,221 | B1 | 4/2002 | Harrigan et al. | |
| 6,659,196 | B1 | 12/2003 | Anderson | |
| 6,678,616 | B1 | 1/2004 | Winkler et al. | |
| 6,894,499 | B2 | 5/2005 | Dumont et al. | |
| 7,431,107 | B2 | 10/2008 | Hill et al. | |
| 7,784,564 | B2 | 8/2010 | Iskander et al. | |
| 7,789,170 | B2 | 9/2010 | Church | |
| 8,061,446 | B2 | 11/2011 | Reid, Jr. et al. | |
| 8,210,284 | B2 | 7/2012 | Buchanan et al. | |
| 2008/0208477 | A1* | 8/2008 | Kelfoun | 702/11 |
| 2009/0114447 | A1* | 5/2009 | Reid et al. | 175/58 |
| 2009/0133932 | A1* | 5/2009 | Church | 175/44 |
| 2010/0282516 | A1* | 11/2010 | Buchanan et al. | 175/58 |
| 2010/0305927 | A1* | 12/2010 | Suarez-Rivera et al. | 703/10 |
| 2011/0094801 | A1* | 4/2011 | Buchanan et al. | 175/249 |

* cited by examiner

CORE ORIENTATION SYSTEMS AND METHODS

BACKGROUND

Wells are generally drilled into the ground or ocean bed to recover natural deposits of oil and gas, as well as other desirable materials that are trapped in geological formations in the Earth's crust. Wells may be drilled using a drill bit attached to the lower end of a drill string. Drilling fluid, or mud, may be pumped down through the drill string to the drill bit. The drilling fluid lubricates and cools the bit, and may additionally carry drill cuttings from the borehole back to the surface.

In various oil and gas exploration operations, it may be beneficial to have information about the subsurface formations that are penetrated by a wellbore. For example, certain formation evaluation schemes include measurement and analysis of the formation pressure and permeability. These measurements may be useful in predicting the production capacity and production lifetime of the subsurface formation.

During a drilling operation, it may be desirable to evaluate and/or measure properties of encountered formations, formation fluids, and/or formation gasses. An example property is the phase-change pressure of a formation fluid, which may be a bubble point pressure, a dew point pressure and/or an asphaltene onset pressure depending on the type of fluid. In some cases, a drillstring is removed and a wireline tool deployed into the wellbore to test, evaluate and/or sample the formation(s), formation gas(es) and/or formation fluid(s). An apparatus and method for sampling and evaluating the fluid may also be available with a logging while drilling (LWD) tool in a drillstring.

While formation testing tools may be primarily used to take measurements and collect fluid samples, other downhole tools may be used to collect core samples. For example, a coring tool may be used to obtain a core sample of the formation. A coring tool may include a hollow coring bit that is advanced into the formation to define a core sample which is then removed from the formation. The core sample may then be analyzed in the tool in the borehole or after being transported to the surface, such as to assess the reservoir storage capacity (porosity) and the permeability of the material that makes up the formation surrounding the borehole, the chemical and mineral composition of the fluids and mineral deposits contained in the pores of the formation, and/or the irreducible water content contained in the formation, among other things.

BRIEF DESCRIPTION OF THE DRAWINGS

A better understanding of the various disclosed system and method embodiments can be obtained when the following detailed description is considered in conjunction with the drawings, in which.

DETAILED DESCRIPTION

Figure 1:
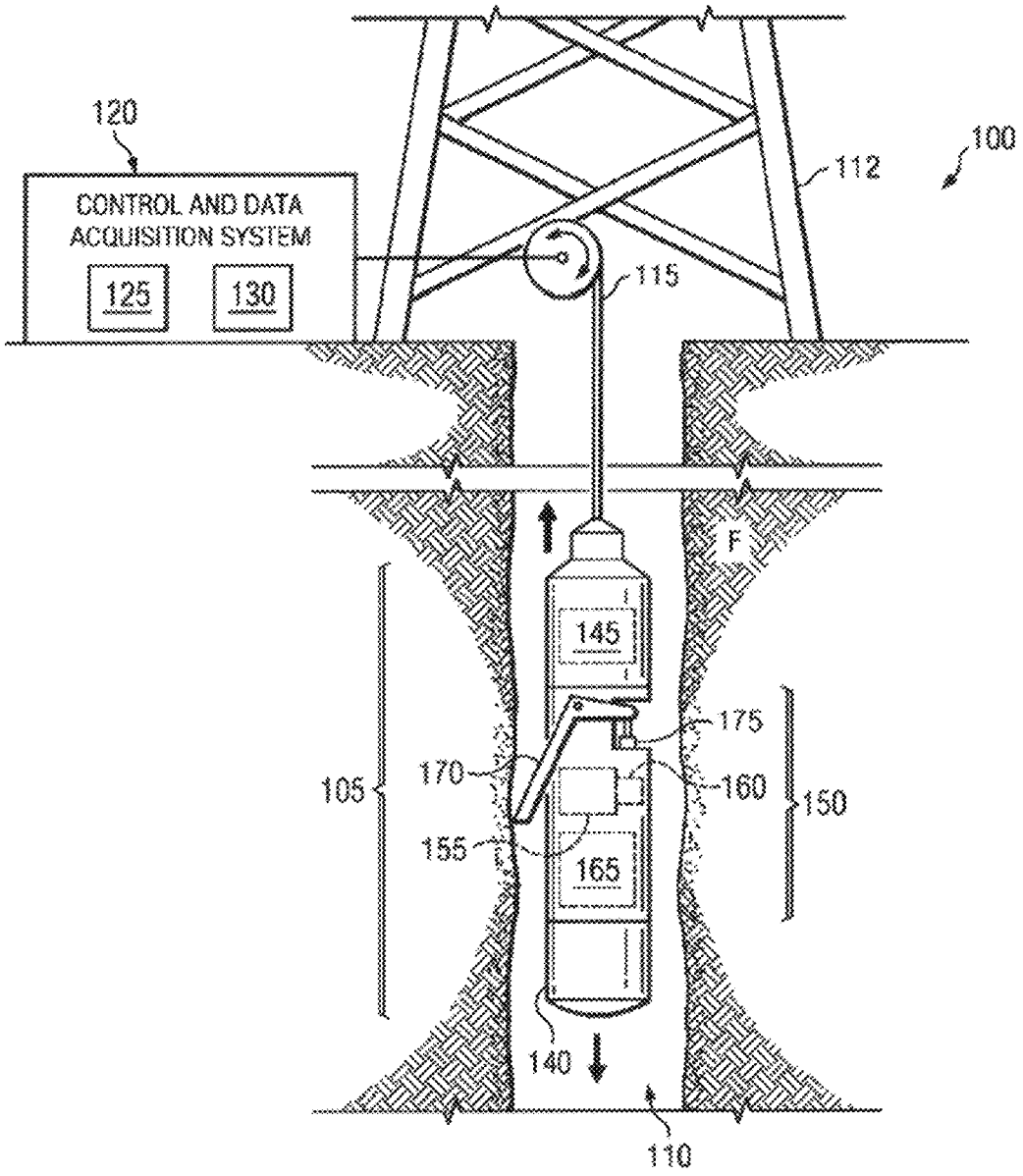
FIG. 1 is an illustrative, wireline environment in accordance with one or more embodiments.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

FIG. 1 depicts an example wireline system 100 in accordance with one or more embodiments. The wireline system 100 may be situated onshore (as shown) and/or offshore. The wireline system 100 may include a wireline assembly 105, which may be used to extract core samples from a subterranean formation F into which a wellbore 110 has been drilled.

The wireline assembly 105 may be suspended from a rig 112 into the wellbore 110 at the lower end of a multi-conductor cable 115, which may be spooled on a winch (not shown) at the Earth's surface. At the surface, the cable 115 may be communicatively and/or electrically coupled to a control and data acquisition system 120. The control and data acquisition system 120 may include a controller 125 having an interface to receive commands from a surface operator. The control and data acquisition system 120 may further include a processor 130 to control the extraction and/or storage of core samples by the wireline assembly 105.

The wireline assembly 105 may have an elongated body and/or housing 140 and may also include a telemetry module 145 and/or a coring module 150. Although the telemetry module 145 is shown as being implemented separate from the example coring module 150, the telemetry module 145 may alternatively be implemented by the coring module 150. Further, additional and/or alternative components, modules and/or tools may also be implemented by the wireline assembly 105.

The coring module 150 may include a selectively pivotable coring tool 155 having a coring bit assembly 160. The coring bit assembly 160 may be operated to obtain a core sample from the formation rock F. The coring module 150 may also include a storage area 165 configured to store core samples taken from the formation F. The storage area 165 may be configured to receive sample cores, which may or may not include a sleeve, canister, or other holder. A brace arm 170 may be provided to stabilize the wireline assembly 105 in the wellbore 110 when the coring bit assembly 160 is operating. The brace arm 170 may be selectively controlled and/or positioned with a piston 175, which may be activated to engage the arm 170 against the surface of the wellbore 110 to stabilize the wireline assembly 105 within the wellbore 110. For example, the arm 170 may be extended until the side of the wireline assembly 105 having the coring bit assembly 160, which is opposite the example arm 170, engages the surface of the wellbore 110. Methods and apparatus to remove cores from the coring tool 155 and/or to place and/or arrange them in the example storage 165 are described in U.S. Pat. No. 8,061,446, entitled "Coring Tool and Method," and issued Nov. 22, 2011, which is hereby incorporated herein by reference for all purposes.

The coring bit assembly 160 may include a hollow drill bit, which is commonly referred to in the industry as a coring bit, that is advanced into the formation F so that material and/or a sample, which is commonly referred to in the industry as a core sample, may be removed from the formation F. A core sample may then be transported to the surface, where it may be analyzed to assess, among other things, the reservoir storage capacity (e.g., porosity) and permeability of the material that makes up the formation F; the chemical and mineral composition of the fluids and/or mineral deposits contained in the pores of the formation F; and/or the irreducible water content of the collected formation material. Among other things, the information obtained from analysis of a core sample may also be used to make formation exploitation and/or production decisions.

Downhole coring operations generally fall into two categories: axial and sidewall coring. Axial or conventional coring involves applying an axial force to advance a coring bit into the bottom of the wellbore 110. Axial coring may be carried out after a drillstring has been removed or tripped from the wellbore 110, and a rotary coring bit with a hollow interior for receiving the core sample is lowered into the wellbore 110 on the end of the drillstring.

By contrast, in sidewall coring the coring bit assembly 160 may be extended radially from the coring module 150 and may be advanced through the side wall of the wellbore 110 into the formation F.

Figure 2:
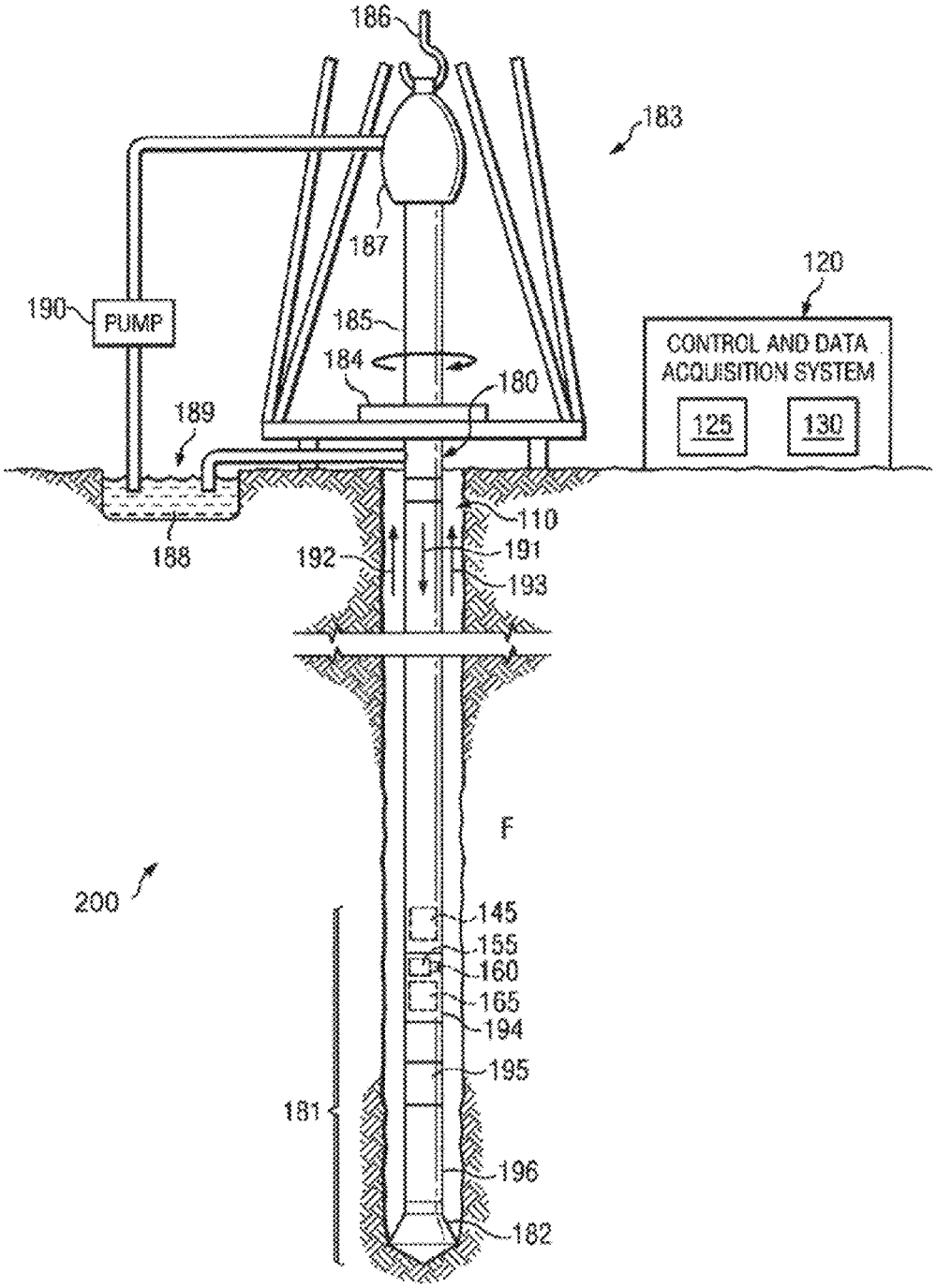
FIG. 2 is an illustrative, drilling environment in accordance with one or more embodiments.

FIG. 2 depicts an example well drilling system 200 in accordance with one or more embodiments, which may be employed onshore (as shown) and/or offshore. In the example drilling system 200, the borehole 110 is formed in the subsurface formation F by rotary and/or directional drilling. A drillstring 180 is suspended within the borehole 110 and has a bottom hole assembly (BHA) 181 having a drill bit 182 at its lower end. A surface system includes a platform and derrick assembly 183 positioned over the borehole 110. The assembly 183 may include a rotary table 184, a kelly 185, a hook 186, and/or a rotary swivel 187. The drillstring 180 may be rotated by the rotary table 184, energized by means not shown, which engages the kelly 185 at the upper end of the drillstring 180. The drillstring 180 may be suspended from the hook 186, which may be attached to a traveling block (not shown) and through the kelly 185 and the rotary swivel 187, which permits rotation of the drillstring 180 relative to the hook 186. Additionally or alternatively, a top drive system, and downhole motor, or any other suitable rotary means may be used.

The drilling system 200 may also include drilling fluid 188, which is commonly referred to in the industry as mud, stored in a pit 189 formed at the wellsite. A pump 190 may deliver the drilling fluid 188 to the interior of the drillstring 180 via a port (not shown) in the swivel 187, causing the drilling fluid 188 to flow downwardly through the drillstring 180 as indicated by the directional arrow 19. The drilling fluid 188 may exit the drillstring 180 via water courses, nozzles, jets and/or ports in the drill bit 182, and then circulate upwardly through the annulus region between the outside of the drillstring 180 and the wall of the wellbore 110, as indicated by the directional arrows 192 and 193. The drilling fluid 188 may be used to lubricate the drill bit 182 and/or carry formation cuttings up to the surface, where the drilling fluid 188 may be cleaned and returned to the pit 189 for recirculation. The drilling fluid 188 may also be used to create a mudcake layer (not shown) on the walls of the wellbore 110. It should be noted that in some implementations, the drill bit 182 may be omitted and the bottom hole assembly 181 may be conveyed via coiled tubing and/or pipe.

The BHA 181 may include, among other things, any number and/or type(s) of while-drilling downhole tools, such as any number and/or type(s) of LWD modules (one of which is designated at reference numeral 194), and/or any number and/or type(s) of MWD modules (one of which is designated at reference numeral 195), a rotary-steerable system or mud motor 196, and/or the example drill bit 182.

The LWD module 194 is housed in a special type of drill collar, as it is known in the art, and may contain any number and/or type(s) of logging tool(s), measurement tool(s), sensor(s), device(s), formation evaluation tool(s), fluid analysis tool(s), and/or fluid sampling device(s). The LWD module 194 may implement the coring module 150 described above in connection with FIG. 1. Accordingly, the LWD module 194 may implement, among other things, the coring tool 155, the coring bit assembly 160, and/or the storage area 165, as shown in FIG. 2. The same or different LWD modules may implement capabilities for measuring, processing, and/or storing information, as well as the telemetry module 145 for communicating with the MWD module 195 and/or directly with surface equipment, such as the control and data acquisition system 120. While a single LWD module 194 is depicted in FIG. 2, it will also be understood that more than one LWD module may be implemented.

The MWD module 195 of FIG. 2 is also housed in a drill collar and contains one or more devices for measuring characteristics of the drillstring 180 and/or the drill bit 182. The MWD tool 195 may also include an apparatus (not shown) for generating electrical power for use by the downhole system 181. Example devices to generate electrical power include, but are not limited to, a mud turbine generator powered by the flow of the drilling fluid, and a battery system. Example measuring devices include, but are not limited to, a weight-on-bit measuring device, a torque measuring device, a vibration measuring device, a shock measuring device, a stick/slip measuring device, a direction measuring device, and an inclination measuring device. Additionally or alternatively, the MWD module 195 may include an annular pressure sensor, and/or a natural gamma ray sensor. The MWD module 195 may also include capabilities for measuring, processing, and sing, and storing information, as well as for communicating with the control and data acquisition system 120. For example, the MWD module 195 and the control and data acquisition system 120 may communicate information either way (i.e., uplink and downlink) using any past, present or future two-way telemetry system such as a mud-pulse telemetry system, a wired drillpipe telemetry system, an electromagnetic telemetry system and/or an acoustic telemetry system. As shown in FIG. 2, the control and data acquisition system 120 of FIG. 2 may also include the controller 125 and/or the processor 130 discussed above in connection with FIG. 1. It should also be noted that the downhole tool can be conveyed into the wellbore via coil tubing or any other suitable conveyance means.

Figure 3:
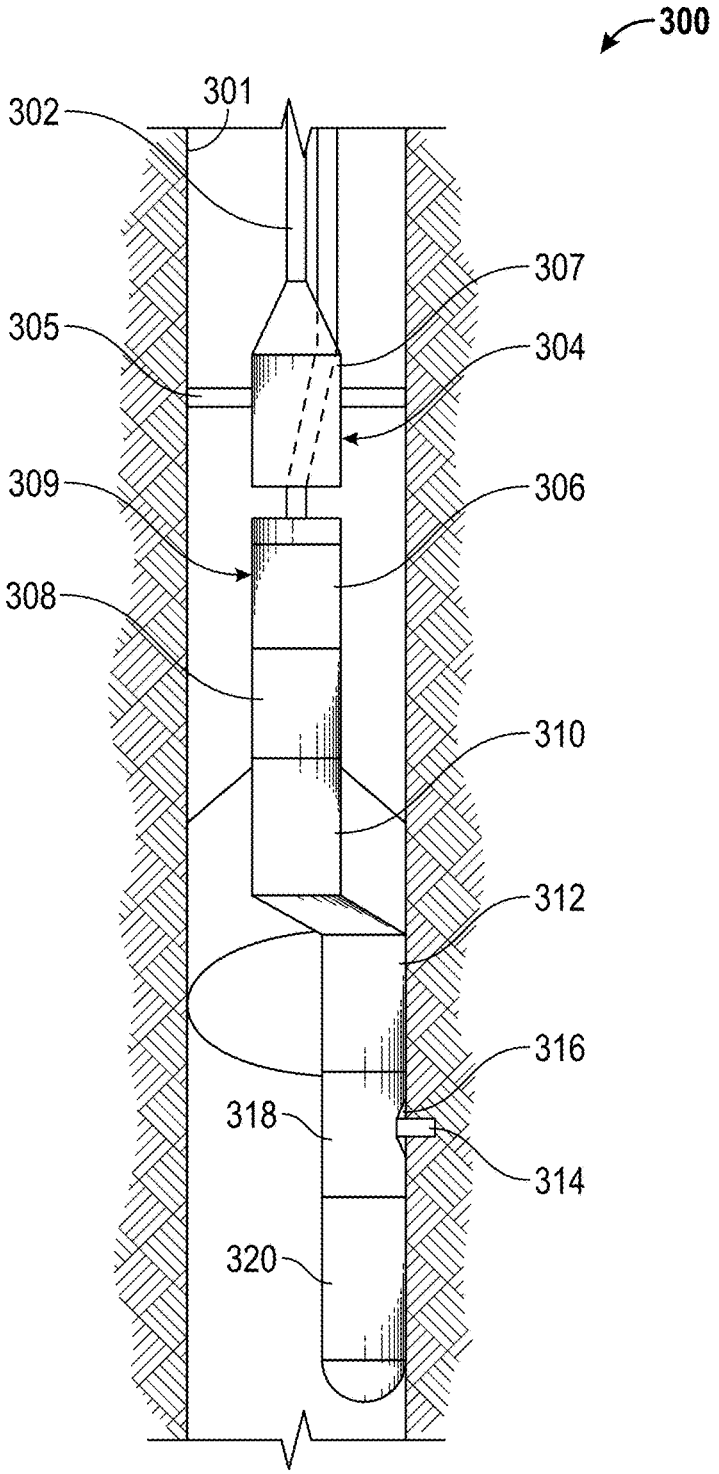
FIG. 3 is an illustrative, schematic view of a tool string in accordance with one or more embodiments.

Referring to FIG. 3, illustrated is a schematic view of a tool string 300 in accordance with one or more embodiments. The tool string 300 is suspended in a wellbore at the end of a wireline cable 302. The cable 302 is spooled on a winch (not shown) at the Earth's surface. The cable 302 may provide electrical power to various components included in the tool string 300 and/or a data communication link between various components in the tool string 300 and a surface electronics and processing system (not shown). The tool string 300 comprises a sidewall coring tool 314. The tool string 300 may also comprise an anchor and power sub 304, a telemetry tool 306, an inclinometry tool 308, a near wellbore imaging tool 310, a lithology analysis tool 312, and other formation measurement tools such as wellbore pressure, formation pressure, resistivity, neutron porosity, azimuthal gamma ray, nuclear spectroscopy, natural gamma ray spectrometry, elemental capture spectroscopy, density, photoelectric effect, sigma measurements, formation density, mineral composition derived from spectroscopy, acoustic/sonic, magnetic resonance measurements.

Example descriptions of the anchor and power sub 304 may be found in U.S. Pat. No. 7,784,564, which is incorporated herein by reference in its entirety for all purposes. For example, the anchor and power sub 304 may comprise two sections. A first section 307 may comprise an anchor 305 configured to secure the first section with respect to the wellbore wall 301, as shown, and a power mechanism (not shown) to controllably translate and/or rotate a second section 309 via an arm. The telemetry tool 306, the inclinometry tool 308, the near wellbore imaging tool 310, the lithology tool 312, other measurement tools, and/or the coring tool 314 may be attached to the second section 309 of the anchor and power sub 304. The anchor and power sub 304 may also include one or more sensors (e.g., linear potentiometers) configured to continuously monitor the position of the second section 309 relative to the first section 307. The anchor and power sub 307 and 309 may be used to bring the coring bit 316 into positional alignment with geological features of the formation, such as a specific bed layer, which may be detected, for example, by the near wellbore imaging tool 310.

The telemetry tool 306 may comprise electronics configured to provide power conversion between the cable 302 and the multiple components in the tool string 300, as well as to provide data communication between the surface electronics and processing system and the tool string 300.

The inclinometry tool 308 provides inclinometer measurements and the orientation of the inclinometry tool 308 is defined by at least three parameters: (1) tool deviation, (2) tool azimuth, and (3) relative bearing. The inclinometry tool 308 determines the tool system axis with respect to the Earth's gravity and magnetic field. Because both vectors are defined within the Earth system, a relation can be established between the inclinometry tool 308 and Earth systems. The inclinometry tool 308 may comprise magnetometers, accelerometers, and/or other known or future-developed sensors. The data provided by these sensors may be used to determine an orientation of an axis the tool string 300, such as with respect to the magnetic North direction and/or the inclination of the tool string 300 with respect to the gravitational field of the Earth. As an example, the inclinometry tool 308 may use both a three-axis inclinometer and a three-axis magnetometer to make measurements for determining these parameters. The magnetometer may determine $F_x$, $F_y$, and $F_z$, and the inclinometer may determine $A_x$, $A_y$, and $A_z$ for the acceleration due to gravity. From these values, deviation, azimuth, and relative bearing of the wellbore may be calculated. For example, the orientation of the wellbore may be determined by aligning the tool axis with the axis of the wellbore or determining the orientation of the tool with respect to the wellbore and then adjusting the inclinometry tool measurements accordingly.

The near wellbore imaging tool 310 may be or comprise a resistivity imaging tool, for example, as described in U.S. Pat. Nos. 4,468,623; 6,191,588; and/or 6,894,499, each incorporated herein by reference in their entirety for all purposes. The near wellbore imaging tool 310 may additionally or alternatively comprise an ultrasonic imaging tool, such as described in U.S. Pat. No. 6,678,616, the entirety of which is incorporated herein by reference for all purposes. The near wellbore imaging tool 310 may additionally or alternatively comprise an optical/NIR (near infrared) imaging tool, such as described in U.S. Pat. No. 5,663,559, the entirety of which is incorporated herein by reference for all purposes. The near wellbore imaging tool 310 may additionally or alternatively comprise a dielectric imaging tool, such as described in U.S. Pat. No. 4,704,581, the entirety of which is incorporated herein by reference for all purposes. The near wellbore imaging tool 310 may additionally or alternatively comprise an NMR (nuclear magnetic resonance) imaging tool, such as described in PCT Publication No. 03/040743, the entirety of which is incorporated herein by reference. The near wellbore imaging tool 310 may be used together with the anchor and power sub 304. For example, the anchor and power sub 307 and 309 may be actuated to align sensing areas of the imaging tool 310 with selected portions of the wellbore wall 301. A measurement may be taken by the imaging tool 310 at multiple positions along the wellbore wall 301. In addition, relative positions of the first and second sections 307, 309 of the anchor and power sub 304 may also be measured with respect to each of the measured multiple positions. A formation image may then be produced from the measurements. Once the image is produced, geological features (e.g., beds, fractures, inclusions) may be identified.

The lithology tool 312 may comprise nuclear spectroscopy sensors configured to determine concentrations of one or more elements in the formation. The lithology tool 312 may be implemented, for example, as described in U.S. Pat. Nos. 4,317,993 and/or 5,021,653, both of which are incorporated herein by reference in their entirety for all purposes. The lithology tool 312 may be used to provide additional information about the mineralogy content of the geological features detected on the image produced with the near well bore imaging tool 310. For example, the anchor and power tool 304 may be actuated to align sensors of the lithology tool 312 with a particular geological feature. A measurement may be taken by the lithology tool 312 and concentrations of one or more elements of the particular geological feature may then be determined.

The sidewall coring tool 314 comprises a core storage section 320 and a drilling section 318. The drilling section 318 comprises a coring bit 316 configured to fit into the coring tool 314 in a retracted position. The coring bit 316 is configured to extend beyond the coring assembly body outer surface and into the wellbore wall 301 (sidewall) in an extended position (shown). Moreover, the coring bit is configured to obtain core samples at one or more angles that are not perpendicular to the longitudinal axis of the sidewall coring tool 314.

Figure 4:
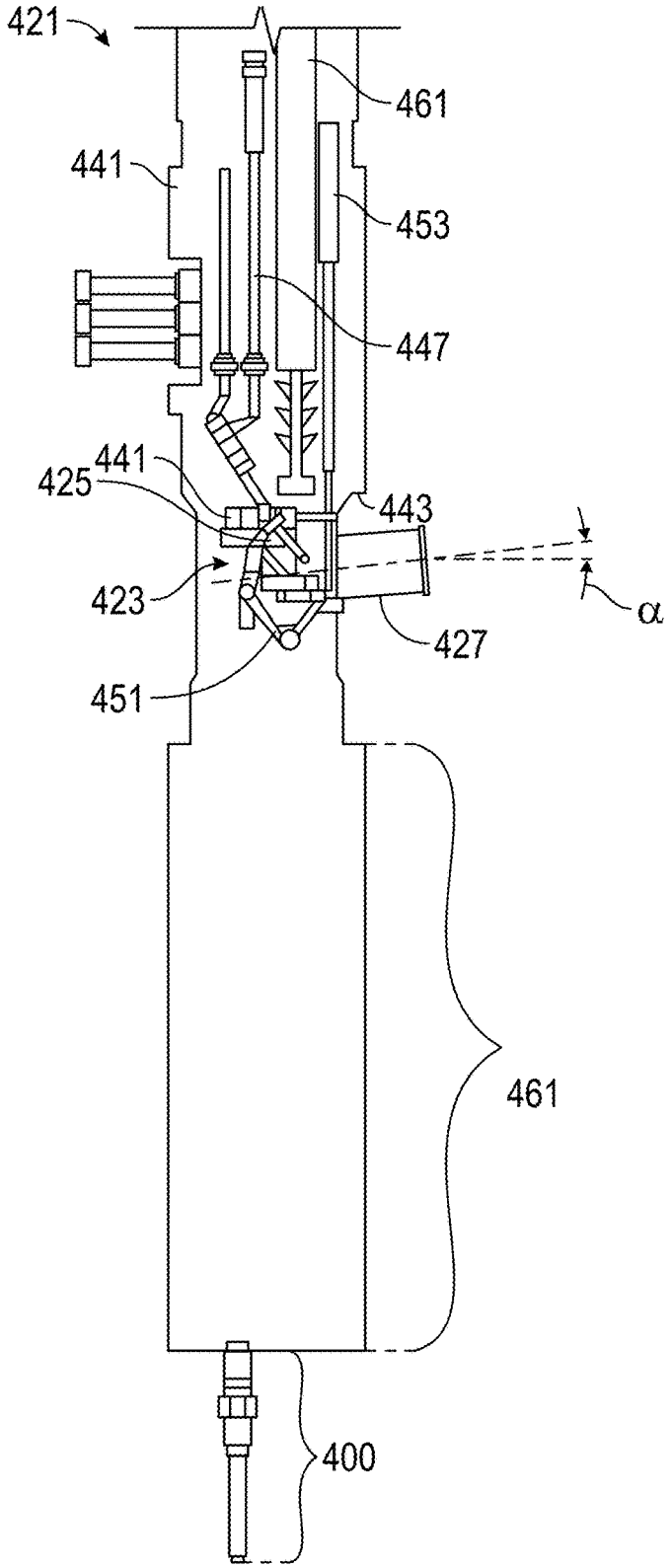
FIG. 4 is an illustrative, coring module in accordance with one or more embodiments.

FIG. 4 illustrates a downhole tool 421 in accordance with various embodiments, detailing the coring tool 423. The downhole tool 421 comprises a coring tool 423 having a motor 425 and a coring bit 427 operatively coupled to the motor 425. The motor 425 is attached to an end of the coring tool 423. The motor 425 may be disposed horizontally adjacent to the coring bit 427 (as shown) or vertically adjacent (above or below) the coring bit 427. The coring bit 427 is configured to slide axially and rotate with respect to the coring tool 423. The motor 425 is configured to drive the coring bit 427 such that the coring bit 427 rotates and penetrates into the formation to obtain a core sample. The downhole tool 421 comprises a tool housing 441 extending along a longitudinal axis 400 of the tool 421. The coring tool 423 and a storage area 461 are disposed within the tool housing 441. The tool housing 441 also comprises a coring aperture 443 defined therein.

The downhole tool 421 comprises rotation link arms 445 and a rotation piston 447 configured to rotatably mount the coring tool 423 within the downhole tool 421. The rotation piston 447 is mounted within the tool housing 441 and is pivotably coupled to the rotation link arms 445. The piston 447 may be actuated to extend and/or retract, in which the movement of the piston 447 may be transferred to the rotation link arms 445 to correspondingly move (e.g., rotate) the coring tool 423. As used herein, the terms "pivotably coupled" or "pivotably connected" may mean a connection between two tool components that allows relative rotating or pivoting movement of one of the components with respect to the other component, but may not allow sliding or translational movement of the one component with respect to the other.

As discussed above, the coring bit 427 is disposed within the downhole tool 421 such that the coring bit 427 is movable between multiple positions with respect to the downhole tool 421, such as between coring positions and an eject position. In the coring positions, the coring bit 427 is disposed adjacent to the formation, such that the coring bit 427 may extend from the coring tool 423 and penetrate into a wall of the formation. The coring bit 427 may be disposed substantially perpendicular to the longitudinal axis 400 of the downhole tool 421, and/or the coring bit 427 may be disposed at an angle with respect to the longitudinal axis 400 of the downhole tool 421 (such that the coring bit 427 is not disposed substantially perpendicular to the longitudinal axis 400 of the downhole tool 421). The downhole tool 421 includes a sensor or sensors to determine the angle of the coring bit 427 with respect to the longitudinal axis 400 of the tool 421. The sensor measurement combined with the measurement of the inclinometry tool can be used for determining the orientation of the coring tool 423, including the orientation of the coring bit 427, with respect to the formation.

The downhole tool 421 may further comprise a system to handle and/or store multiple core samples, in conjunction with the storage area 461 in which core samples may be stored until the coring assembly is brought to the surface. The storage area 461 can contain multiple canisters for storing the collected core samples.

The downhole tool 421 and components thereof may be configured to operate independently from each other. For example, rotation of the coring tool 423 can be independent from the extension and retraction of the coring bit 427. That is, the rotation system comprising the rotation link arms 445 and the rotation piston 447 can operate independently from the extension system comprising the extension link arms 451 and the extension piston 453. Thus, the coring bit 427 can extend and/or retract from the coring tool 423 regardless of the rotation position of the coring tool 423. As such, the coring bit 427 may be extended and/or retracted to capture core samples from a formation at multiple positions and/or multiple angles (such as an angle across a diagonal plane) with respect to the downhole tool 421. This independence enables the coring bit 427 to capture core samples at various angles with respect to the downhole tool 421.

Those having ordinary skill in the art will appreciate that, in addition to the above embodiments shown and described above with respect to a coring assembly, other arrangements and mechanisms may be used to enable a coring assembly and/or a coring bit to move between multiple positions within a tool without departing from the scope of the present disclosure. Additional examples of mechanisms that may be used within a coring tool are disclosed within U.S. Pat. Nos. 4,714,119; 5,667,025; and 6,371,221, all of which are incorporated herein by reference in their entirety for all purposes.

Figure 5:
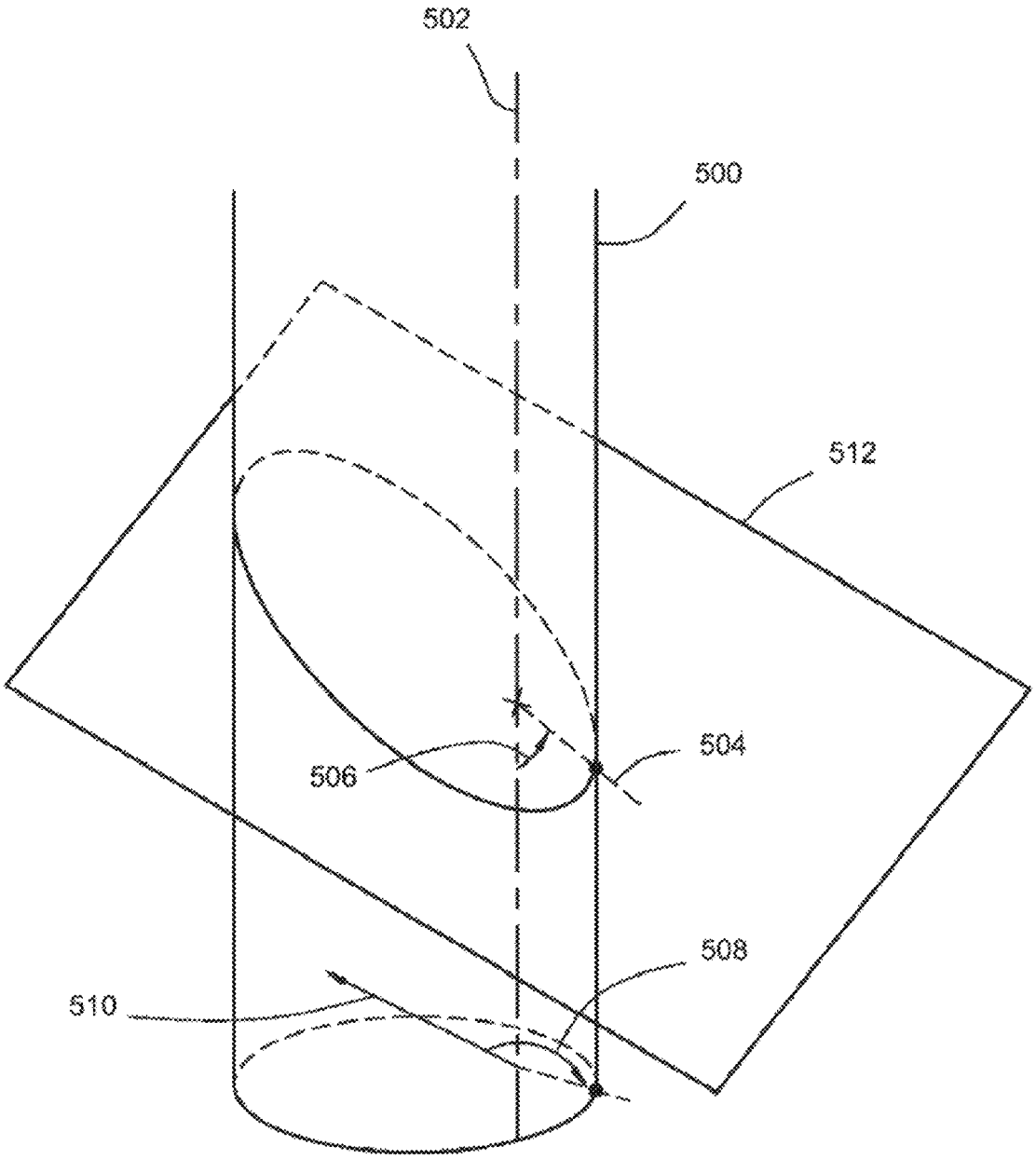
FIG. 5 is an illustrative, schematic view of a wellbore where the coring tool can be adjusted via the coring tool angle and bit orientation in accordance with one or more embodiments.

FIG. 5 illustrates a schematic view of a wellbore demonstrating one or more aspects in accordance with various embodiments. A coring tool, such as those described above, disposed in the wellbore 500 may comprise a longitudinal axis 502 extending through the wellbore 500, and may further include a coring direction 504 for a coring bit. The coring direction 504 may be disposed at a desired coring angle 506 with respect to the axis 502, and the coring tool may have a desired coring tool orientation 508, in which the coring tool orientation 508 may be measured about the axis 502, such as with respect to a magnetic field 510 within the wellbore 500 (such as with respect to the magnetic North direction of the Earth). Accordingly, based upon these multiple degrees of freedom for the coring tool, such as desired angle 506 and orientation 508 for the coring tool, the coring tool may have a coring direction that may be able to align with a determined location (or plane) of interest 512, such as a bedding plane within the formation.

Figure 6:
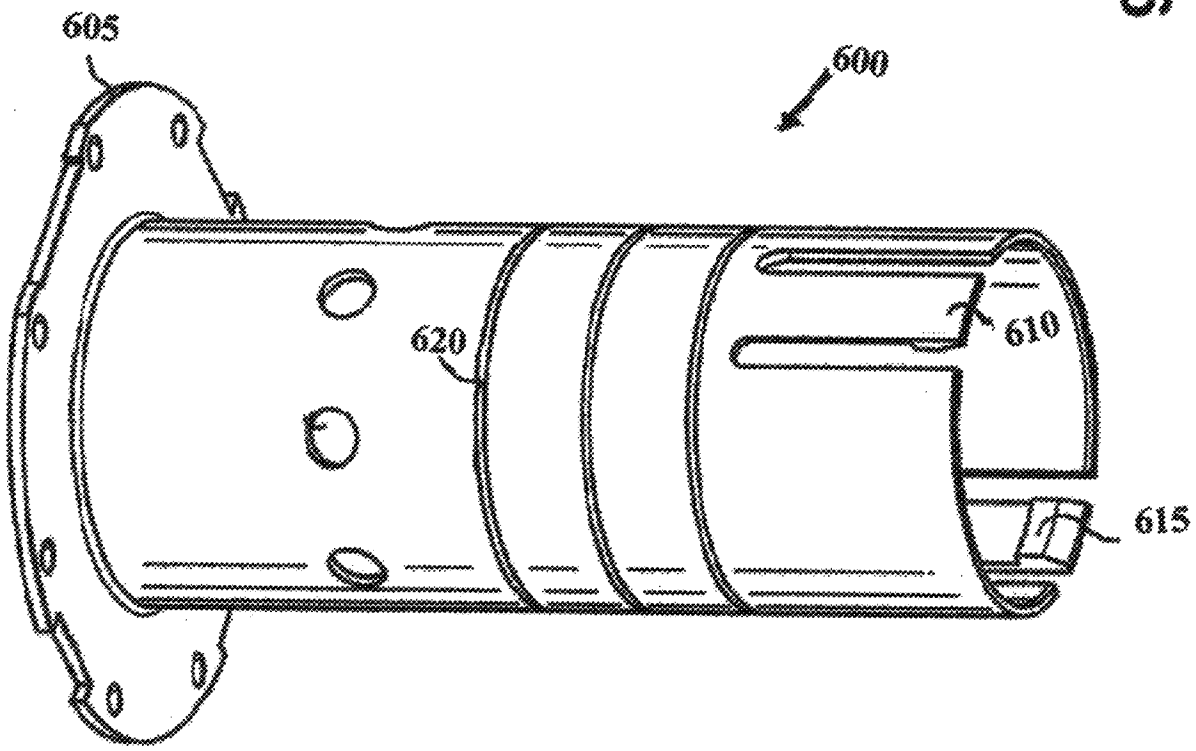
FIG. 6 is an illustrative coring sleeve in accordance with one or more embodiments.

FIG. 6 is an illustrative, schematic view of a static sleeve that is attached to the coring bit assembly, in accordance with one or more embodiments. The static sleeve 600 of FIG. 6 includes a flange 605 configured to attach the sleeve 600 to the coring bit assembly. The example sleeve 600 may comprise one or more retention members, one of which is designated at reference numeral 610. Each of the example retention member(s) 610 may comprise one or more marking devices. As an example, the marking device may include one or more protrusion 615. The protrusion(s) 615 may be configured to create a mark, score, or groove on the core as coring bit assembly is extended into the formation. As the static sleeve 600 is attached to the coring bit, the position of the mark(s), score(s) and/or groove(s) on the core are related to the relative orientation of the formation from which the core is taken and the axis of the coring assembly and, thus, the axis of the wellbore. In other words, the mark(s), score(s) and/or groove(s) are indicative of horizontal and/or vertical planes with respect to the wellbore axis. When more than one protrusion 615 is implemented by the static sleeve 605, the protrusions 615 may be rotationally positioned, shaped and/or arranged to enable unambiguous determination of the orientation of the core sample with respect to the formation. Such markings, scores and/or grooves may be particularly advantageous when taking cores in non-isotropic or anisotropic formations. In such cases, properties of the core and/or the formation may depend on the direction in which they are measured. When the cores are, for example, analyzed in a laboratory, the properties of the obtained cores may be measured and/or identified with respect to orientation marking(s), score(s) and/or groove(s). These core properties may then be related to formation properties that would be measured along directions relatives to the wellbore axis, such as, for example, horizontal or vertical permeability. The protrusion(s) 615 may also be used for gripping the core once the core is severed from the formation.

Figure 7:
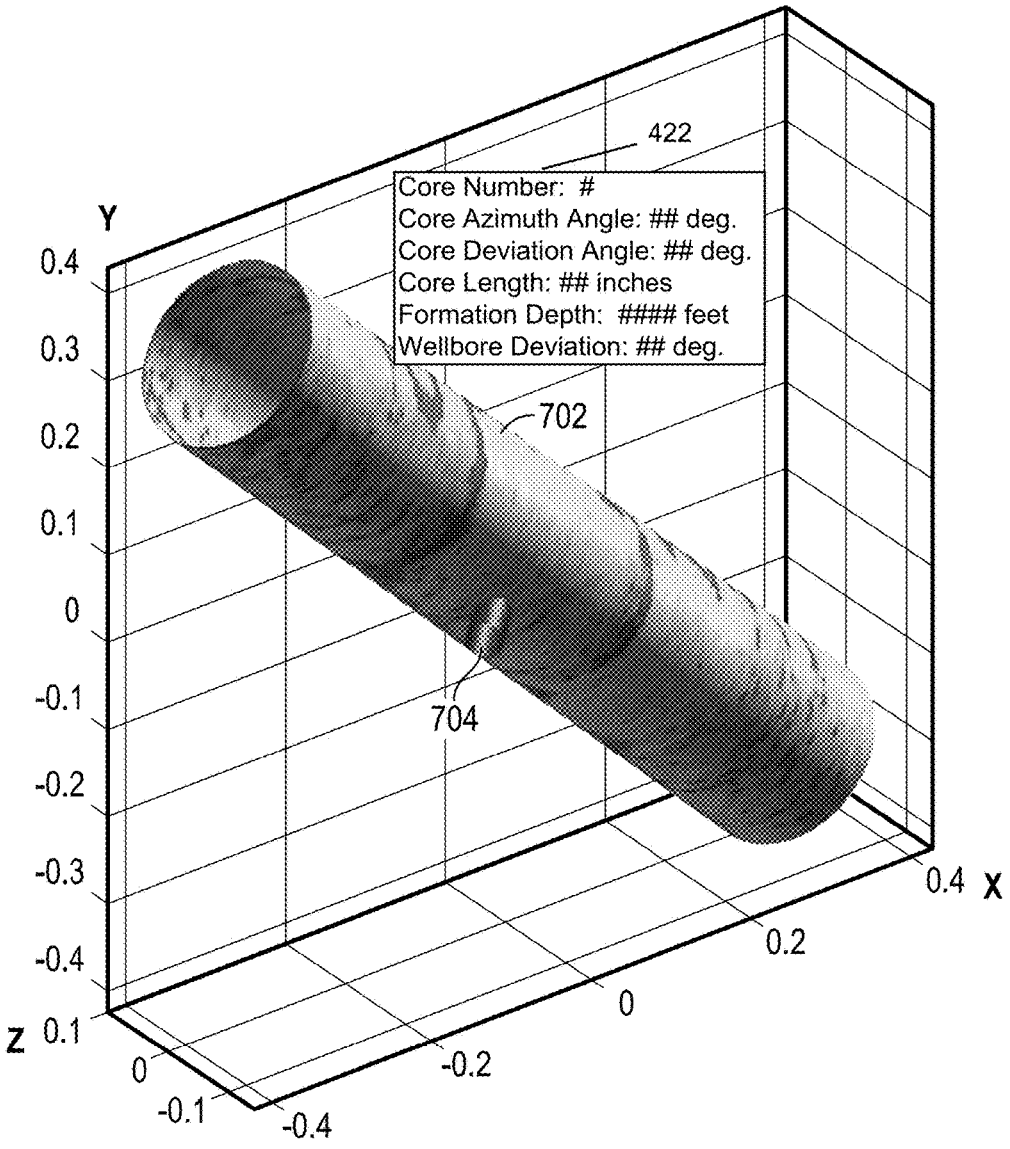
FIG. 7 is an illustrative, graphical display of information from a core orientation in accordance with one or more embodiments.

FIG. 7 is an illustrative example core orientation display of the wellbore and core sample in accordance with various embodiments. The graph includes an x-axis that represents position in the x-direction (e.g., North) and a y-axis that represents position in the y-direction (e.g., East) of a model wellbore, representing the position of the wellbore with respect to the Earth. The z-axis represents the diameter of the model wellbore. Using the combination of the known orientation of the core sample with respect to the downhole tool 421 and the known orientation of the downhole tool 421 with respect to the formation, precise data on the position and orientation of the collected core sample in relation to the wellbore is known. In order to determine the position or location, the depth in the well (where the core is taken) should also be taken into account. The depth may be measured with the wireline cable system or any other suitable means. For example, information 422 about the core sample is displayed, such as the core label number, azimuth angle, deviation angle, and core length. Information about the wellbore is also presented graphically. As an option, this information may be displayed graphically, as in FIG. 7, which shows an image of the orientation of the wellbore 702 as well as the orientation of the core sample 704 with respect to the position of the formation in the Earth. Additionally, a measured property of the formation, such as porosity, may also be displayed along the wellbore. Knowing the orientation of the core sample with respect to the position of the formation in the Earth, the core sample can be re-oriented in the position it was in before being removed from the wellbore using the marking on the core sample as a reference.

The capability of re-orienting the core sample is beneficial for evaluation of a formation. For example, knowledge about the vertical permeability of an oil and gas producing subterranean formation is sometimes useful to properly anticipate the production performance of a hydrocarbon reservoir. The spacing of wells, the rate of production, stimulation procedures, and pressure maintenance programs for both primary and secondary recovery are often based to a large extent upon a determination or estimation of vertical permeability.

The horizontal to vertical permeability ratio represents the contrast in permeability between the horizontal and vertical planes within a formation (anisotropic permeability). A large horizontal to vertical permeability ratio implies a relatively low vertical permeability, which creates a larger pressure drop near the wellbore due to the vertical component of flow.

For example, one of the tests that may be performed on sample core is a flow test. This test may provide porosity and/or permeability values of the formation F from which the core has been obtained. These values are often used together with other formation evaluation data to estimate the amount of hydrocarbon that can potentially be produced from the formation or to optimize stimulation of the formation, such as through hydraulic fracturing. However, it should be appreciated that the accuracy of the flow test result may be sensitive to being able to re-orient the core sample in relation to the formation. By doing so, the results of analyses performed on the core samples may be more accurate, thereby providing better evaluation of the formation and thus the hydrocarbon reserves.

Figure 8:
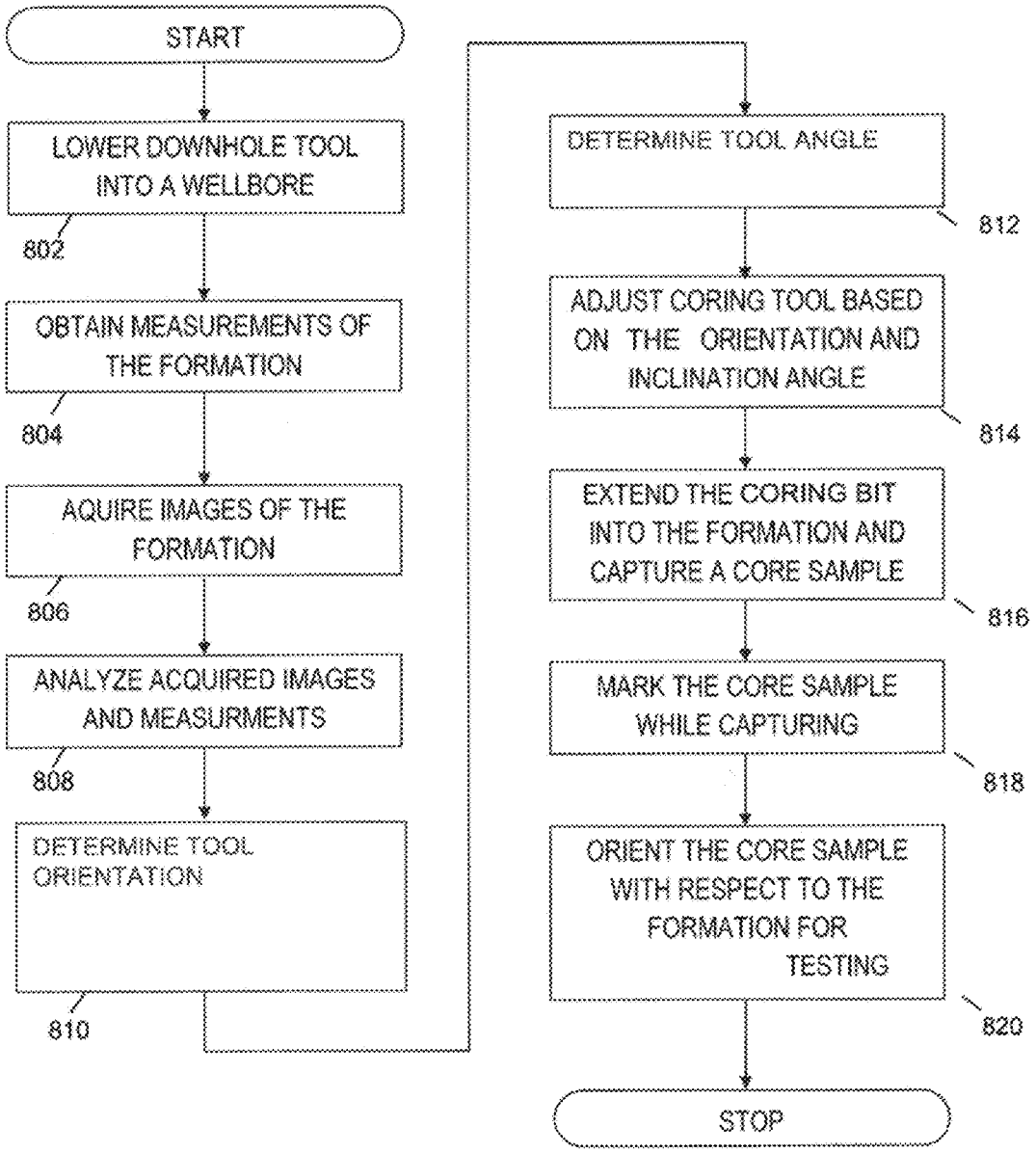
FIG. 8 is a flowchart of illustrating a method of obtaining a core sample in accordance with one or more embodiments.

FIG. 8 is a flowchart illustrating a method in accordance with one or more embodiments. The method is for evaluating a subterranean formation and includes lowering (block 802) a downhole tool into a wellbore. For example, as shown in FIG. 3, the tool string 300 may be lowered into a wellbore on a wireline cable 302.

The downhole tool may be employed to obtain (block 804) measurements of the formation, such as formation lithology, wellbore pressure, formation pressure, resistivity, neutron porosity, azimuthal gamma ray, nuclear spectroscopy, natural gamma ray spectrometry, elemental capture spectroscopy, density, photoelectric effect, sigma measurements, formation density, mineral composition derived from spectroscopy, acoustic/sonic, magnetic resonance measurements, and the like. Further, the downhole tool may be employed to acquire (block 806) images of the formation using techniques such as resistivity imaging, ultrasonic imaging, optical/NIR imaging, dielectric imaging NMR imaging, and the like. The measurements and/or the images may be analyzed (block 808) to determine an area of interest for obtaining a core sample.

Orienting the coring tool to the area of interest may include determining a coring tool orientation (block 810) with respect to the formation and determining a coring bit inclination angle (block 812) with respect to the axis of the tool. The orientation and inclination angle are determined by comparing the known dimensions and position of the tool with the desired position of the coring tool in the wellbore needed for obtaining a core sample from the area of interest.

For example, the inclinometry tool 308 may be employed to determine a three-dimensional orientation of the downhole tool and/or coring tool relative to the Earth. In one embodiment, the inclinometry tool 308 may include a magnetometer for determining a magnetic field position of the downhole tool and an accelerometer for determining a gravitational field position of the downhole tool. These measurements may be combined to determine the orientation of the tool relative to the Earth. Further, the geographical position of the tool also may be determined based on a depth of the downhole tool in the well bore, which in certain embodiments may be measured based on a wireline cable length or casing length. Further, sensors in the coring tool may be employed to determine the inclination angle of the coring tool and/or coring bit with respect to the downhole tool.

The coring tool is then adjusted (block 814) to the coring tool orientation and coring bit inclination angle by adjusting the position of the entire tool within the wellbore from the surface and/or using the rotation link arms 445 and the rotation piston 447 to adjust the angle of the coring bit 427 relative to the tool axis 400.

After the coring tool position is set, the coring bit is extended (block 816) into the formation to capture a core sample. For example, as shown in FIG. 3, the coring bit of the coring tool 314 is extended into the formation. During, or after obtaining the core sample, the core sample is marked (block 818) to indicate the orientation of the obtained core sample with respect to the tool. For example, as shown in FIG. 6, the protrusions 615 scratch the outside surface of the obtained core sample. The mark indicates the orientation of the obtained core sample with respect to the tool after the core sample is retrieved from the tool, which in turn may indicate the rotational position of the core with respect to the formation.

The orientation of the obtained core sample with respect to the tool combined with the known orientation of the tool with respect to the Earth, allows a geographical position and orientation of the core sample with respect to the Earth to be determined. For example, a controller (e.g., control system 120) may receive the orientation information from the downhole tool and determine the geographical position of the core sample. In another embodiment, the geographical position of the core sample may be determined by a controller located in the downhole tool or located at an offsite location, such as a laboratory. The controller also may generate a graphical representation of the wellbore and core sample where the core sample is disposed in the geographical position. In certain embodiments, x, y, and z axes (e.g., where the x-axis may represent North, the y-axis may represent East, and the z-axis may represent depth) may be included on the graphical representation, as shown in FIG. 7, to indicate the geographical position of the wellbore and the core sample. Further, in certain embodiments, one or more properties of the formation or core sample may be displayed on the graphical representation. For example, the core length, core sample number, formation depth, wellbore deviation, or a combination thereof, among others, may be shown on the graphical representation.

The geographical position of the core sample allows the core sample to be re-oriented in the same directional position as it was when it was obtained in the formation using the marking as a reference. For example, the re-orientation may include processing the inclinometry tool measurements to determine and display on a computer monitor the orientation of the core sample as it was when it was obtained, including possibly displaying the position of the mark on the core sample. Specific position coordinates for re-orienting the core sample are determined, and the core sample may be re-oriented as it was in the formation when obtained using the marking on the core sample as a reference. Tests on the re-oriented core sample may then be run to determine a property of the formation, including directional properties such as vertical and horizontal permeability testing. For example, in certain embodiments, the core sample may be tested to determine formation properties, and the determined properties may be based at least in part on the geographical position of the core sample relative to the Earth. For example, porosity and/or permeability results of a flow test may depend on the laboratory test results and the geographical position of the core sample, which may indicate the flow direction. In certain embodiments, the flow direction for performing a flow test may be determined based on the geographical position of the core sample.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words "means for" together with an associated function.

What is claimed is:

1. A method comprising:

determining a geographical orientation of a downhole tool relative to Earth, wherein the downhole tool comprises a sidewall coring tool positioned to extract a core sample from a formation of the Earth;

determining an orientation of the core sample with respect to the downhole tool;

marking the core sample with a marking device connected with a static sleeve;

determining, based on the geographical orientation of the downhole tool and the orientation of the coring sample, a geographical orientation of the core sample with respect to the Earth; and displaying a graphical representation of the wellbore and the core sample, wherein the graphical representation comprises an image of the core sample with respect to the wellbore and the Earth, and wherein the graphical representation includes an x-axis, y-axis, and z-axis, wherein the z-axis represents a wellbore diameter, and wherein the graphical representation displays core information comprising: a core label number, an azimuth angle, a deviation angle, a core length, and wellbore information comprising a porosity.

2. The method of claim 1, wherein determining a geographical orientation of a downhole tool comprises measuring a magnetic field position of the downhole tool and measuring a gravitational field position of the downhole tool.

3. The method of claim 2, wherein determining a geographical orientation comprises determining a depth of the downhole tool in a wellbore.

4. The method of claim 1, wherein determining a geographical orientation of a downhole tool comprises determining a three-dimensional geographical orientation of the downhole tool.

5. The method of claim 1, wherein determining an orientation of the core sample comprises determining an angle of a coring bit of the coring tool.

6. A method comprising:

lowering a downhole tool into a wellbore, wherein the downhole tool comprises a housing, a measurement tool and a sidewall coring tool positioned to extract a core sample from a formation;

determining a geographical orientation of the downhole tool relative to Earth;

determining an inclination angle of the coring tool relative to the downhole tool;

extending the coring tool into the formation at the inclination angle to obtain a core sample of the formation;

marking the core sample to indicate a rotational position of the core sample in the formation while obtaining the core sample with a marking device connected with a static sleeve;

determining an orientation of the core sample with respect to the downhole tool based on the inclination angle and the rotational position;

determining, based on the geographical orientation of the downhole tool and the orientation of the coring sample, a geographical orientation of the core sample with respect to the Earth; and displaying a graphical representation of the wellbore and the core sample, wherein the graphical representation comprises an image of the core sample with respect to the wellbore and the Earth, and wherein the graphical representation includes an x-axis, y-axis, and z-axis, wherein the z-axis represents a wellbore diameter, and wherein the graphical representation displays core information comprising: a core label number, an azimuth angle, a deviation angle, a core length, and wellbore information comprising a porosity.

7. The method of claim 6, wherein determining a geographical orientation of the downhole tool comprises measuring a deviation, azimuth, and relative bearing of a housing of the downhole tool.

8. The method of claim 6, comprising measuring a property of the formation using the downhole tool and generating a graphical representation of the wellbore based on the measured property.

9. The method of claim 6, comprising displaying geographical directions defining the geographical orientation of the core sample on the graphical representation.

10. The method of claim 6, comprising:

removing the core sample from the downhole tool;

testing the core sample to determine a formation property, wherein the formation property is determined based at least in part on the geographical orientation of the core sample.

11. The method of claim 10, wherein testing the core sample comprises performing a flow test to determine a porosity of the formation, a permeability of the formation, or both.

12. A system comprising:

a downhole tool comprising:

an inclinometry tool for determining a geographical orientation of a downhole tool relative to Earth;

a sidewall coring tool positioned to extract a core sample from a formation of the Earth and configured to determining an orientation of the core sample with respect to the downhole tool, wherein the sidewall coring tool comprises a marking tool connected with a static sleeve;

a controller configured to determine, based on the geographical orientation of the downhole tool and the orientation of the coring sample, a geographical orientation of the core sample with respect to the Earth; and display a graphical representation of the wellbore and the core sample, wherein the graphical representation comprises an image of the core sample with respect to the wellbore and the Earth, and wherein the graphical representation includes an x-axis, y-axis, and z-axis, wherein the z-axis represents a wellbore diameter, and wherein the graphical representation displays core information comprising: a core label number, an azimuth angle, a deviation angle, a core length, and wellbore information comprising a porosity.

13. The system of claim 12, wherein the coring tool comprises a marking device configured to mark a rotational position of the core sample relative to the formation for determining the orientation of the core sample with respect to the downhole tool.

14. The system of claim 12, wherein the coring tool comprises a sensor configured to measure an inclination angle of a coring bit of the coring tool for determining the orientation of the core sample with respect to the downhole tool.

15. The system of claim 12, wherein the inclinometry tool comprises an accelerometer, a magnetometer, or both.

* * * * *